United States Patent [19]

Hedstrom et al.

[11] 4,056,296

[45] Nov. 1, 1977

[54] DOCUMENT HOLDER

[75] Inventors: Norman A. Hedstrom, Worcester; David M. Wright; Jerome O'Toole, both of Shrewsbury, all of Mass.

[73] Assignee: Wright Line Inc., Worcester, Mass.

[21] Appl. No.: 667,613

[22] Filed: Mar. 17, 1976

[51] Int. Cl.[2] ..... A47B 63/00; B42F 15/00

[52] U.S. Cl. ..... 312/184; 312/183; 312/188; 402/38

[58] Field of Search ..... 312/183, 184, 188; 402/4, 38; 16/DIG. 13

[56] References Cited

U.S. PATENT DOCUMENTS

| | | | |
|---|---|---|---|
| 938,530 | 11/1909 | Webster | 402/38 |
| 1,996,463 | 4/1935 | Dawson et al. | 402/38 |
| 1,997,447 | 4/1935 | Birbaum | 402/38 |
| 2,080,975 | 5/1937 | Welk et al. | 402/4 |
| 3,008,470 | 11/1961 | Rubinstein | 402/4 |
| 3,540,832 | 11/1970 | Morris | 402/4 |
| 3,628,877 | 12/1971 | Barnes, Jr. | 402/4 |
| 3,801,175 | 4/1974 | Giulie | 312/184 |
| 3,865,445 | 2/1975 | Dean et al. | 312/184 |
| 3,884,586 | 5/1975 | Michaelis et al. | 402/38 |
| 3,936,201 | 2/1976 | Kenney et al. | 402/4 |
| 3,980,360 | 9/1976 | Wright et al. | 260/465.5 A |

FOREIGN PATENT DOCUMENTS

| | | | |
|---|---|---|---|
| 337,488 | 2/1959 | France | 312/184 |
| 1,164,627 | 5/1969 | United Kingdom | 16/DIG. 13 |
| 1,056,999 | 3/1967 | United Kingdom | 16/DIG. 13 |

*Primary Examiner*—Paul R. Gilliam
*Assistant Examiner*—Victor N. Sakran
*Attorney, Agent, or Firm*—Milton E. Gilbert

[57] ABSTRACT

A novel loose-leaf holder is provided for binding documents such as a multi-leaf computer printout and mounting the same in a suspension-filing and/or storing system. The holder comprises a plastic body which is molded as an integral unit and comprises two side sections which are connected together by a hinge section so that they can be swung toward and away from one another, and document mounting posts carried by one side section and engageable by the other side section. Manually releasable locking means are provided for locking the two side sections together so as to captivate documents which are mounted on the binding posts.

32 Claims, 18 Drawing Figures

DOCUMENT HOLDER

This invention relates to document holders and more particularly to devices for binding and filing documents and other sheet materials.

THE PRIOR ART

Holders for loose-leaf sheet materials are well known. Document holders designed for use in suspension filing systems are also well known. The prior art further includes document holders designed for binding and filing computer printouts. Such devices are exemplified in U.S. Pat. Nos. 3,865,445, 3,540,832, 3,884,586 and 3,628,877.

SUMMARY OF THE INVENTION

The primary object of this invention is to provide a new plastic document holder which is designed to be used as a binder for loose-leaf sheet materials such as catalog and reference manual pages, ledger sheets, computer printouts, drawings, prints and the like.

Another object is to provide a device which is designed to be used as a multi-document carrier in a suspension filing system of the type comprising a single support hanger or two side support rails.

Still another object is to provide a document holder which comprises two or more integral document-mounting posts.

A further object is to provide a novel document holder which can be made wholly of a molded plastic, has only a few moving parts, can be adapted to accommodate documents of different sizes, offers the capability of attachment and detachment of documents, is sturdy, relatively light weight, and adapted for use in a suspension filing system, and can be made in different colors or provided with distinctive indicia to facilitate storage in readily identifiable groups.

These and other objects of the invention are achieved by providing a document holder that comprises two opposed side sections which are connected to one another by an integral hinge so that they can be swung toward and away from one another, document mounting posts carried by one side section and engageable by the other side section, and locking means for releasably locking the two side sections together whereby to captivate documents that are mounted on the binding posts. The two side sections are formed with hook means for mounting the holder to a suitable support hanger on the rails of a suspension filing system.

BRIEF DESCRIPTION OF THE DRAWINGS

In the several views, like numbers are used to designate like parts, so as to facilitate a concise description of the invention.

DETAILED DESCRIPTION

Figure 1:
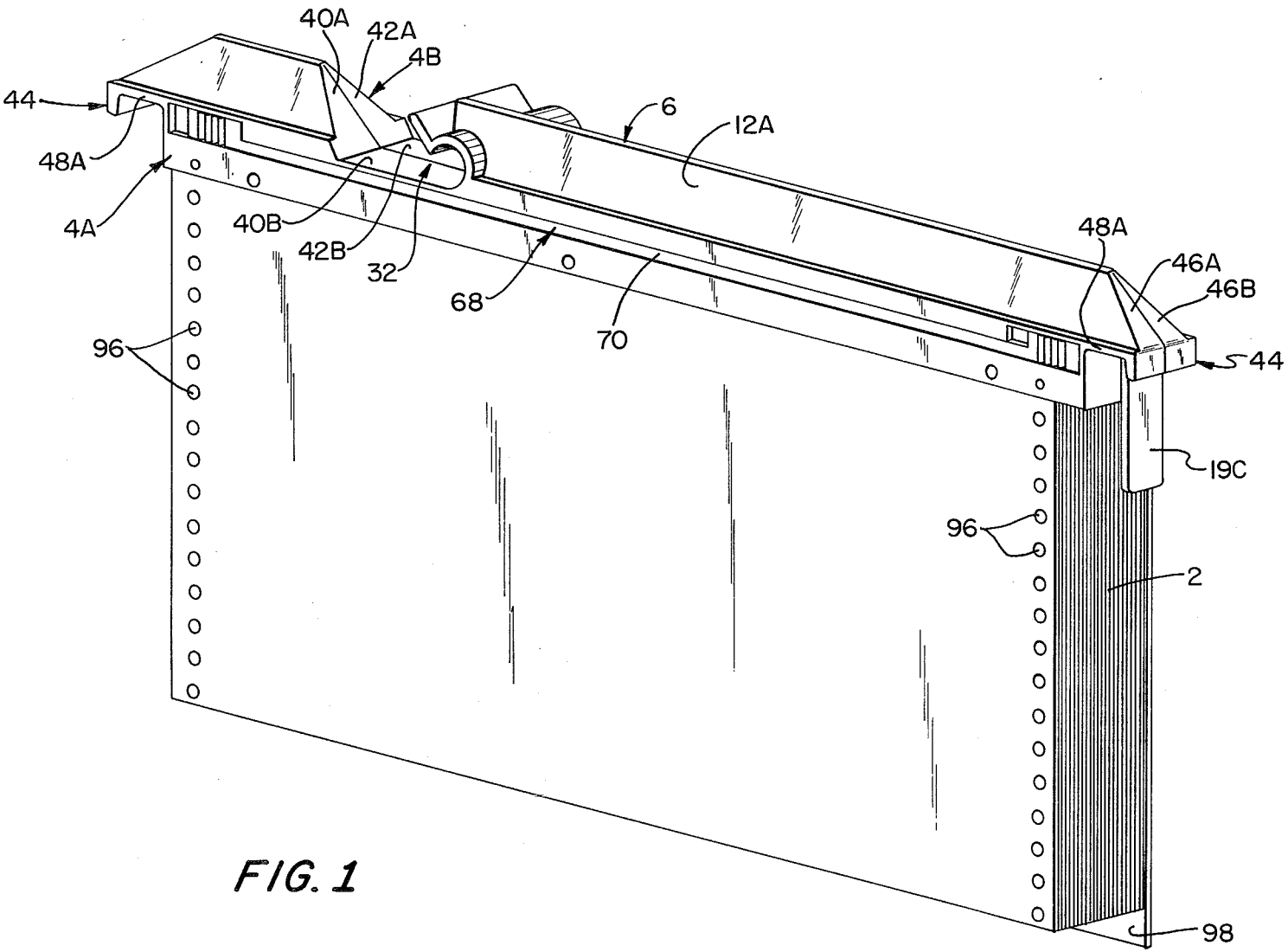
FIG. 1 is a perspective view of a document holder constituting a preferred embodiment of the invention and a computer printout carried by the holder.

Referring now in greater detail to the drawings, there is shown in FIG. 1 a hanging type document holder which is adapted for use in a suspension filing system and designed to bind loose-leaf sheet materials, including a computer printout 2 of the type which is folded accordianwise into a plurality of folds or sheets. The holder comprises two opposite side sections 4A and 4B and a hinge section 6 which are made of a suitably flexible plastic and are molded as one piece. By way of example but not limitation, the plastic may be polyethylene or polypropylene. When the holder is in its closed condition, i.e., with its side sections confronting and locked to one another as hereinafter described, it forms in cross-section a document receiving channel 8 (FIG. 9) with the channel being inverted when the holder is in use to store documents in a suspension filing system. More particularly, side sections 4A and 4B comprise side walls 12A and 12B each having one edge formed integral with hinge section 6, and side limbs 14A and 14B formed integral with the other edge of side walls 12A and 12B. As seen best in FIG. 6, side limbs 14A and 14B are disposed at like obtuse angles with respect to side walls 12A and 12B respectively. Additionally side sections 4A and 4B comprise longitudinally extending partitions 16A and 16B respectively which extend at a right angle to the limbs and additional longitudinally spaced reinforcing struts 18A and 18B which are disposed at right angles to the limbs and partitions 16A and 16B. The opposite ends of side sections 4A and 4B are closed off by end walls 19A and 19B respectively that extend at a right angle to limbs 14A and 14B.

Still referring specifically to FIGS. 1-7 and 9, two posts 20 are formed integral with (or preformed and secured to) limb 14B adjacent its two ends and two holes 24 are formed in limb 14A in alignment with and positioned to receive posts 20. Preferably each hole 24 is formed with a tapered countersink 26 on the inner side of limb 14A.

Figure 7:
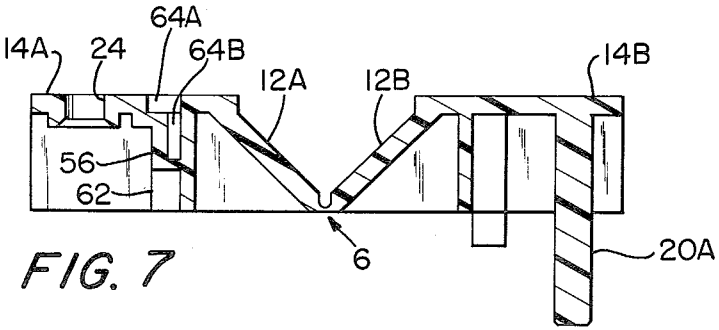
FIGS. 6 and 7 are enlarged cross-sectional views taken substantially along lines 6—6 and 7—7 of FIGS. 2 and 3 respectively.
Figure 6:
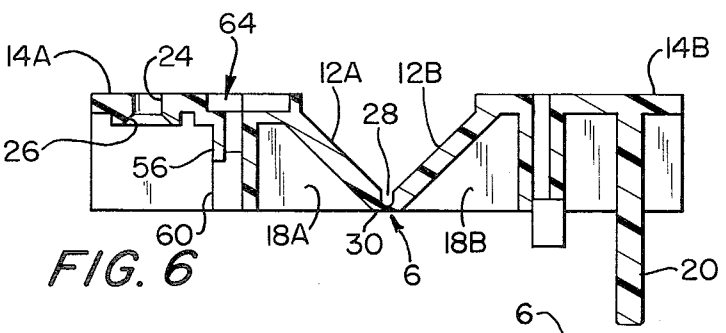
Figure 9:
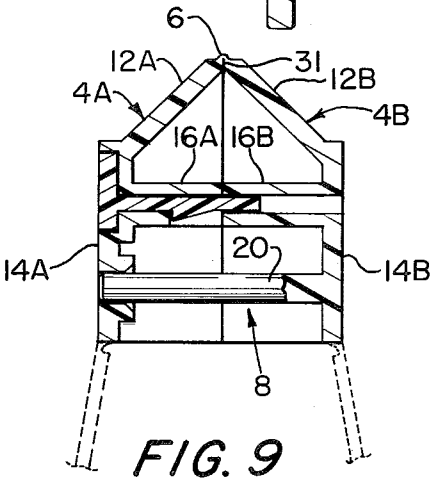
FIG. 9 is an enlarged cross-sectional view taken substantially along line 9—9 of FIG. 5.
Figure 8:
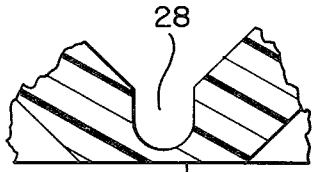
FIG. 8 is an enlargement of a portion of FIG. 6.
Figure 11:
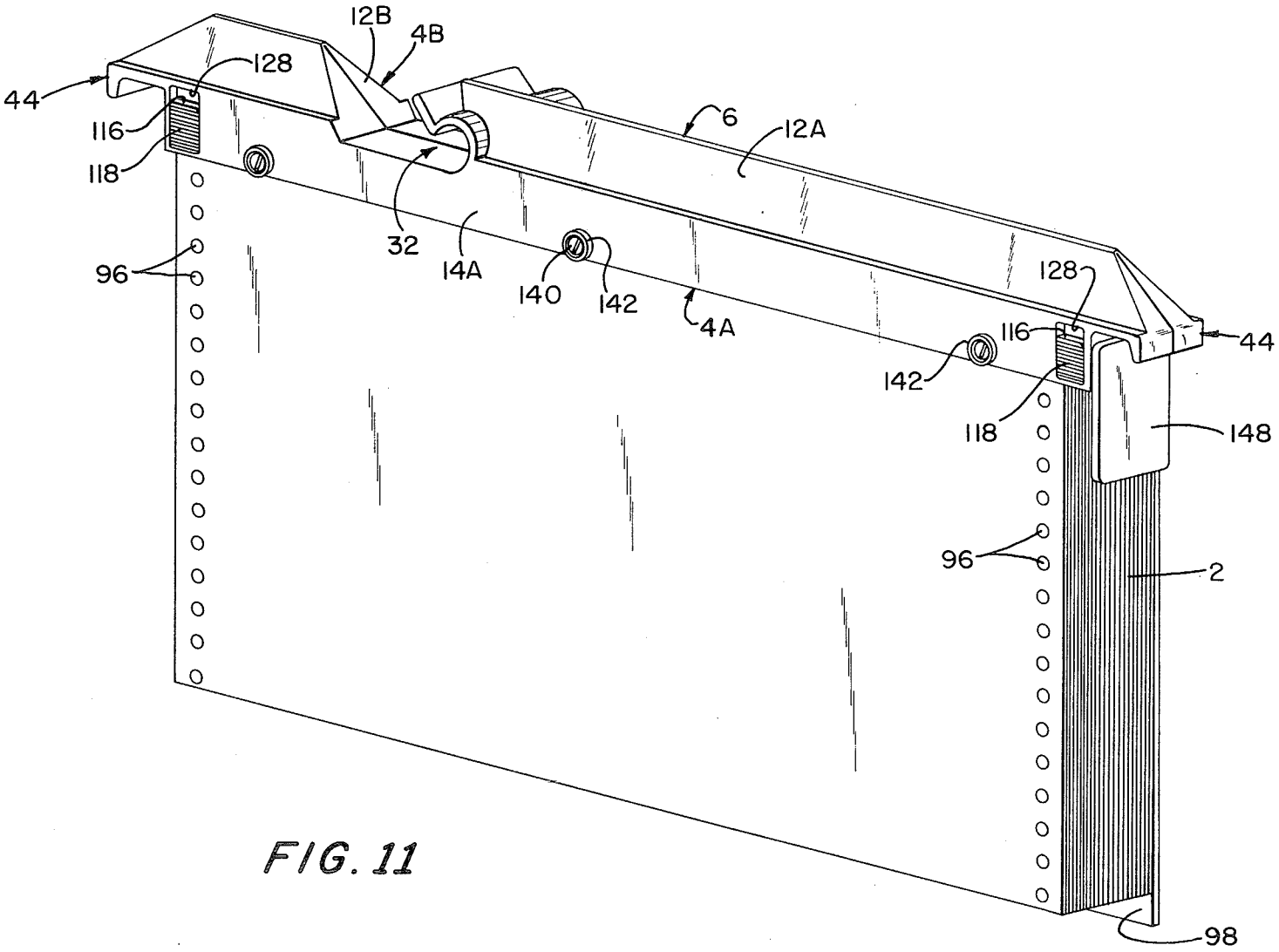
FIG. 11 is a view like FIG. 1 of a second embodiment of the invention.

Referring now to FIGS. 2, 3 and 6-9, the holder is molded flat, i.e. with the side sections separated and the limbs 14A and 14B being substantially co-planar, as shown in FIGS. 6 and 7. The hinge section 6 is formed so that in its as-molded condition (FIGS. 6 and 7) it is characterized by a thickness at its center less than that of limbs 14A and 14B, whereby it is capable of yielding to provide the requisite hinge action. In the preferred embodiment of the invention the thickness of the hinge section is made less than that of limbs 14A and 14B by providing a groove 28 on its outer side and forming a flat surface 30 where the inner surfaces of side walls 12A and 12B would normally intersect. As a consequence of such a construction, the hinge section 6 is capable of being flexed and distended so as to permit the side sections 4A and 4B to be swung together into the closed position (FIGS. 1 and 9); at the same time the hinge section has enough strength and toughness to withstand the flexing involved in repeatedly opening and closing the holder. When the side sections are swung into closed position, the flat surface 30 folds along its length into two like halves which come into face to face engagement with one another as shown at 31 in FIG. 9. Surface 30 folds along a line 33 (FIG. 3) which is substantially the middle of groove 28. When the holder is in its closed condition, the side walls 12A and 12B and hinge section 6 form an arch of generally triangular shape as seen in FIG. 9.

The upper portion of the holder defined by side walls 12A and 12B is characterized by a hook section identified generally by numeral 32. The latter is formed by molding the holder so that in its flat as-molded condition it has a generally heart-shaped hole 34, (FIGS. 2 and 3) with one-half of the hole being formed in side wall 12A and limb 14A and the other half being formed in side wall 12B and limb 14B, and hook-like projections 36A and 36B on side walls 12A and 12B. Hook section 32 confronts plate sections 40A and 40B on side section 4A and plate sections 42A and 42B on side section 4B. Plate sections 40A and 42A are flat triangular sections that are integral with and extend at right angles to side walls 12A and 12B respectively, while plate sections 40B and 42B are portions of partitions 16A and 16B respectively. When the holder is in its closed condition, the edge of plate sections 40A and 40B and projection 36A confront and engage the edges of plate sections 42A and 42B and projection 36B respectively, whereby projections 36A and 36B form a rounded hook and plate sections 40A, 42A and 40B, 42B form two angularly disposed surfaces that facilitate engaging the hook with a hanger or retaining member not shown.

Figure 2:
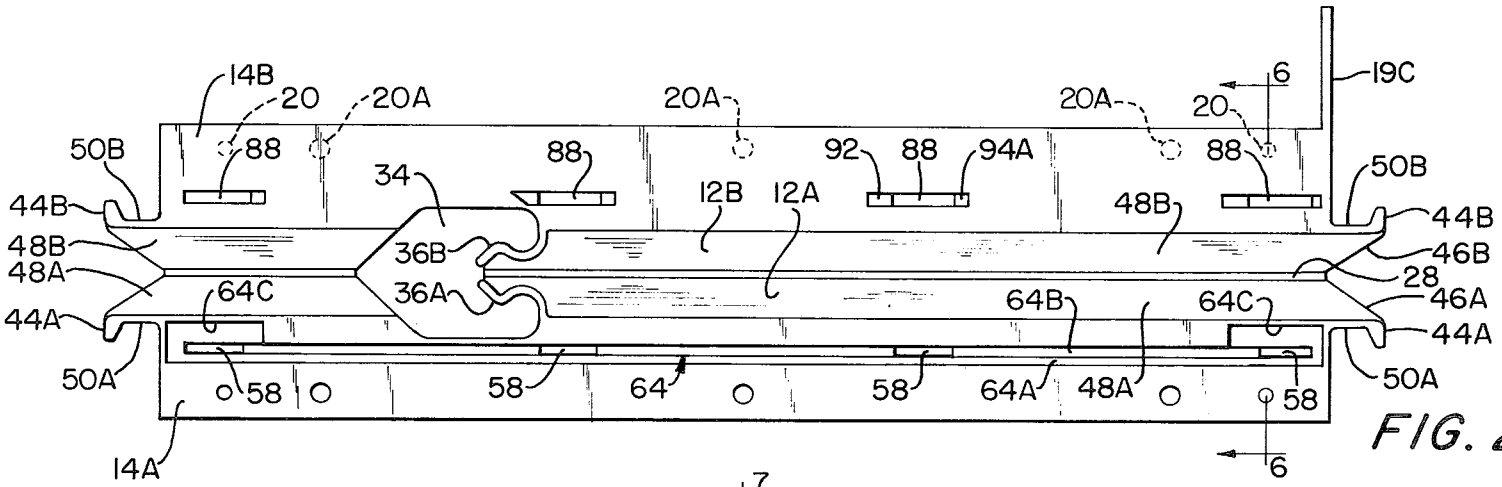
FIG. 2 is a plan view of the same holder in its fully open condition.
Figure 3:
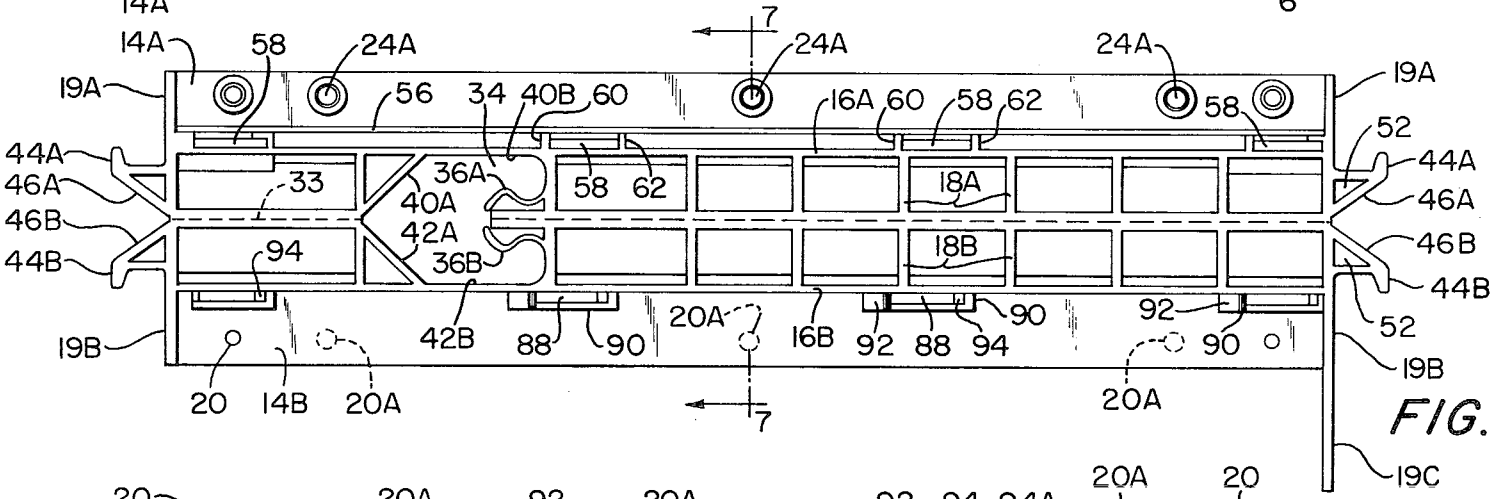
FIG. 3 is a bottom view of the fully open holder of FIG. 2.
Figure 4:
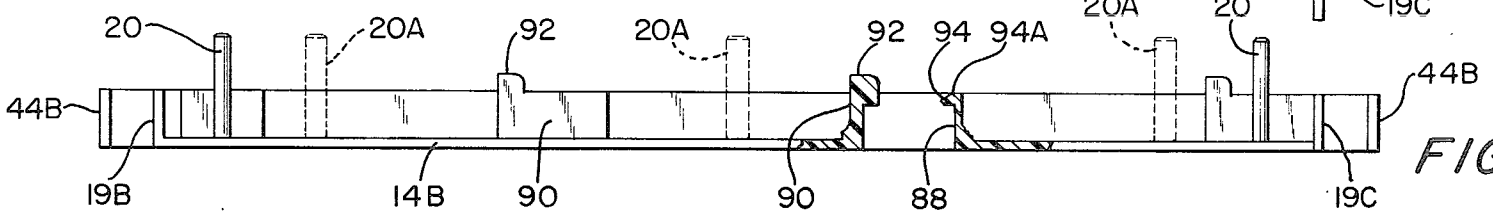
FIG. 4 is a side view of the holder as shown in FIG. 3, with a portion thereof shown in section.

Preferably, but not necessarily, the side sections 4A and 4B also are constructed so that when they are swung together they will form a hook 44 at each end of the holder, whereby the holder may be supported by the two rails of a conventional suspension filing system, e.g., like the holder shown in U.S. Pat. No. 3,628,877. As seen in FIGS. 2 and 3, the opposite ends of side walls 12A and 12B and limbs 14A and 14B have integral hook-shaped extensions 44A and 44B which comprise (1) surfaces 46A and 46B that extend at an acute angle to groove 28 and at a right angle to side walls 12A and 12B and limbs 14A and 14B respectively, and (2) surfaces 48A and 48B that are extensions of the outer surfaces of side walls 12A and 12B and surfaces 50A and 50B that are extensions of the outer surfaces of limbs 14A and 14B respectively. When the side sections 4A and 4B are swung together so that extensions 44A are brought into engagement with extensions 44B, the surfaces 46A and 46B form inclined surfaces that close off the opposite ends of the arch formed by side wall sections 12A and 12B and hinge section 6. Although the extensions 44A and 44B are shown as being hollow due to cavities 52 (FIG. 3), it is to be understood that they could be made solid.

Figure 10:
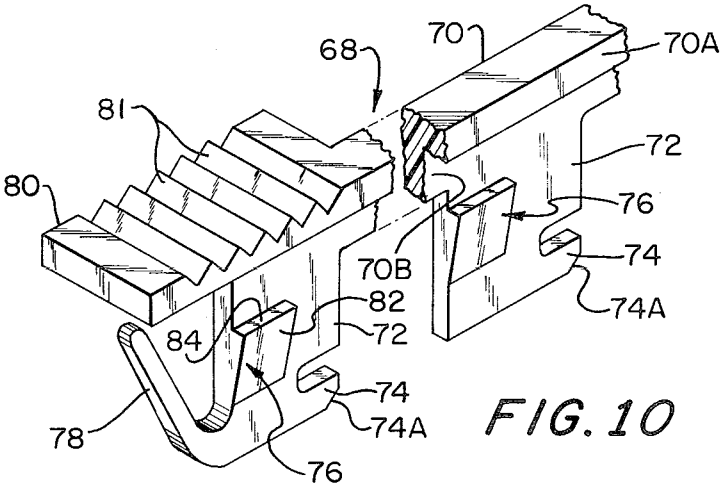
FIG. 10 is an enlarged and fragmentary perspective view of significant portions of the locking unit.

Locking mean are provided for releasably locking the side sections 4A and 4B in the closed condition of FIGS. 1 and 9. For this purpose the partition 16A is formed with a relatively thick base section 56 along its entire length and the side section 4A is formed with a selected number, e.g., four as shown, of apertures 58 spaced along its length. Each of the apertures 58 is elongate lengthwise of the holder and is formed through the base section 56 as shown. A pair of ribs 60 and 62 is molded on the outer side of partition 16A along opposite sides of each aperture 58. The ribs 62 associated with the first and last apertures 58 are formed with an L-shaped cross-section as shown in FIG. 3. Side section 4A also is provided with a longitudinally extending groove identified generally at 64 formed in the outer surface of limb 14A. Groove 64 is of L-shaped cross-section and thus comprises a relatively shallow section 64A and a right angle relatively deep section 64B. The latter section of groove 64 intersects all of the apertures 58. The shallow section 64A of groove 64 terminates in relatively wide end sections 64C. The purpose of apertures 58 and groove 64 is to accommodate a multi-latch locking unit identified generally by the numeral 68 (FIGS. 1 and 10).

This multi-latch locking unit comprises an elongate bar 70 of which makes a snug sliding fit in the L-shaped groove 64. Bar 70 has an L-shaped cross-section and thus comprises a first section 70A which fits slidably in groove section 64A and a second section 70B which fits slidably in groove section 64B. The locking unit also comprises a plurality of latching elements each consisting of a flat body section 72 which is formed integral with section 70B of bar 70 and has a hook 74 at one end and a wedge-shaped detent 76 projecting on one side. A spring means also is provided to bias the locking unit to a locking position. The spring means may be a discrete component formed separately from the locking unit. Preferably, however, it is formed as an integral part of the locking unit. Accordingly the locking unit is made of a resilient plastic or metal material and one or more of the latch elements is provided with a spring in the form of a resilient finger 78 that is an integral part of the latch element and is located at a side opposite the side at which hook 74 is located. In the illustrated embodiment only one of the latch elements has a spring finger 78.

An additional feature of the locking unit is formation of an enlargement of the section 70A at each end of bar 70 so as to provide two buttons 80 which are serrated as shown at 81 to facilitate manual operation of the locking unit. The buttons 80 fit in the wide end portions 64C of groove 64 and one sized so that they can move longitudinally but not laterally of the end portion 64C. The sections 70A and 70B of bar 70 are sized so that they will make a close sliding fit with the portions 64A and 64B respectively of groove 64. The function of detents 76 is to retain the locking unit in operative disposition with side section 4A of the holder. The sloping surfaces 82 of detents 76 allows the latter to be forced through the apertures 58 while the flat end surfaces 84 of the detents coacts with the confronting surface of the base section 56 to retain the locking unit in operative relation with side section 4A (see FIG. 9). It is to be appreciated that the holder is made of a material that has just enough resiliency to allow detents 76 to be forced through apertures 58.

The latch elements extend through the apertures 58 and are sized so that (a) they can be moved in the apertures lengthwise of the holders and (b) they project beyond the edges of partition 16A and struts 18A far enough to lock to catches provided on the other side section 4B as hereinafter described. The spring finger(s) 78 of the locking unit engages the rib(s) 60 and they coact to bias the locking unit away from the rib(s) 60 toward the rib(s) 62, i.e., toward the right in FIGS. 1 and 5.

Referring now to FIGS. 2–7 and 9, the other side section 4B is provided with means adapted to be engaged by and connect to the locking unit so as to maintain the holder in a closed condition. In the embodiment of FIGS. 1–10 such means comprises a plurality of catches, one for each latch element carried by locking unit 58. More specifically, the limb 14B of side section 4B is provided with four apertures 88 which are elongated lengthwise of the holder body and are located in alignment with corresponding ones of apertures 58 of side section 4A. For reinforcement purposes and also to provide the necessary catches, the partition 16B is formed with four flat projections 90 on the side facing away from struts 18B. Projections 90 will terminate flush with the edge surface of partition 16B except that three of them have an extension 92 at one end that protrudes beyond the edge surfaces of partition 16B and struts 18B. Each of the projections is hollow and defines a hole of rectangular cross-section which is an extension of an aperture 88. In addition, one side of each projection 90 is formed with an inside lip 94 (FIGS. 3 and 4) that is shaped so that it can function as a catch for one of the latch elements previously described.

Figure 5:
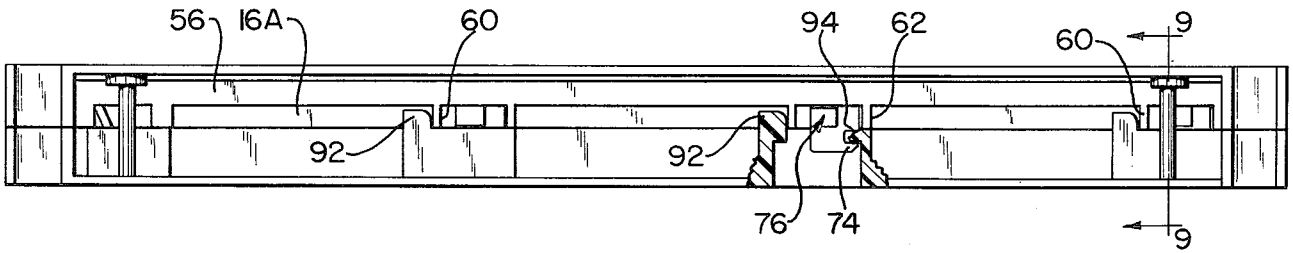
FIG. 5 is a bottom view, partly in section, of the holder in closed condition.

Following is a description of how the locking unit and the catches cooperate to retain the holder in the closed condition. When the side sections 4A and 4B are swung toward one another, the bevels 74A of hooks 74 engage the slanted upper surfaces 94A of catches 94 and notwithstanding the bias presented by spring finger 78, they are cammed lengthwise of the holder away from the catches far enough to pass around the catches. As soon as this occurs, spring finger 78 moves the locking unit lengthwise of the holder away from extension 92 so as to place the hooks 74 in interlocking relation with catches 94. To open the holder to remove or add documents, it is necessary to manually engage buttons 80 and thereby slide the locking unit lengthwise in a direction (leftward in FIG. 1) to cause the hooks 74 to be disengaged from catches 94, whereupon the side sections 4A and 4B may be swung away from one another to the position shown in FIGS. 6 and 7. Extensions 92 serve as stops. When the side sections 4A and 4B are swung into closed position, the initial engagement of hooks 74 with catches 94 results in a force that urges side section 4A to distort and be displaced longitudinally relative to side section 4B. Such action is prevented by extensions 92 which move along side of and preferably engage ribs 60 when the holder is swung to closed position, as shown in FIG. 5.

It is to be noted that the posts 20 are located so that they will be able to penetrate the sprocket holes 96 which form part of a conventional computer printout. It should be appreciated also that the posts 20 may be located so that the holder may function as a two-ring loose-leaf binder. Similarly, the posts 20 may be omitted and replaced by three posts 20A that permit the holder to function as a three-ring binder. In this connection it is to be noted that limb 14A may be formed with three additional holes 24A in anticipation of the mold for the holder body being modified to produce posts 20A instead of posts 20.

Of course, it is not necessary for the posts to be molded as an integral part of the holder body. Instead the posts may be preformed and secured in holes provided for that purpose in limb 14B.

An additional optional feature of the invention is to provide means for holding a label with indicia identifying the documents attached to the holder. In the embodiment of FIG. 1 this is achieved by forming one of the end walls 19B with a flat extension 19C that serves as a tab to which an identifying label may be attached by a suitable adhesive. A relatively stiff backing sheet 98 also may be mounted on posts 20 to facilitate handling and also to protect the edges of the bound documents.

Figures 12, 13, 14, 15, 16, 17, 18:
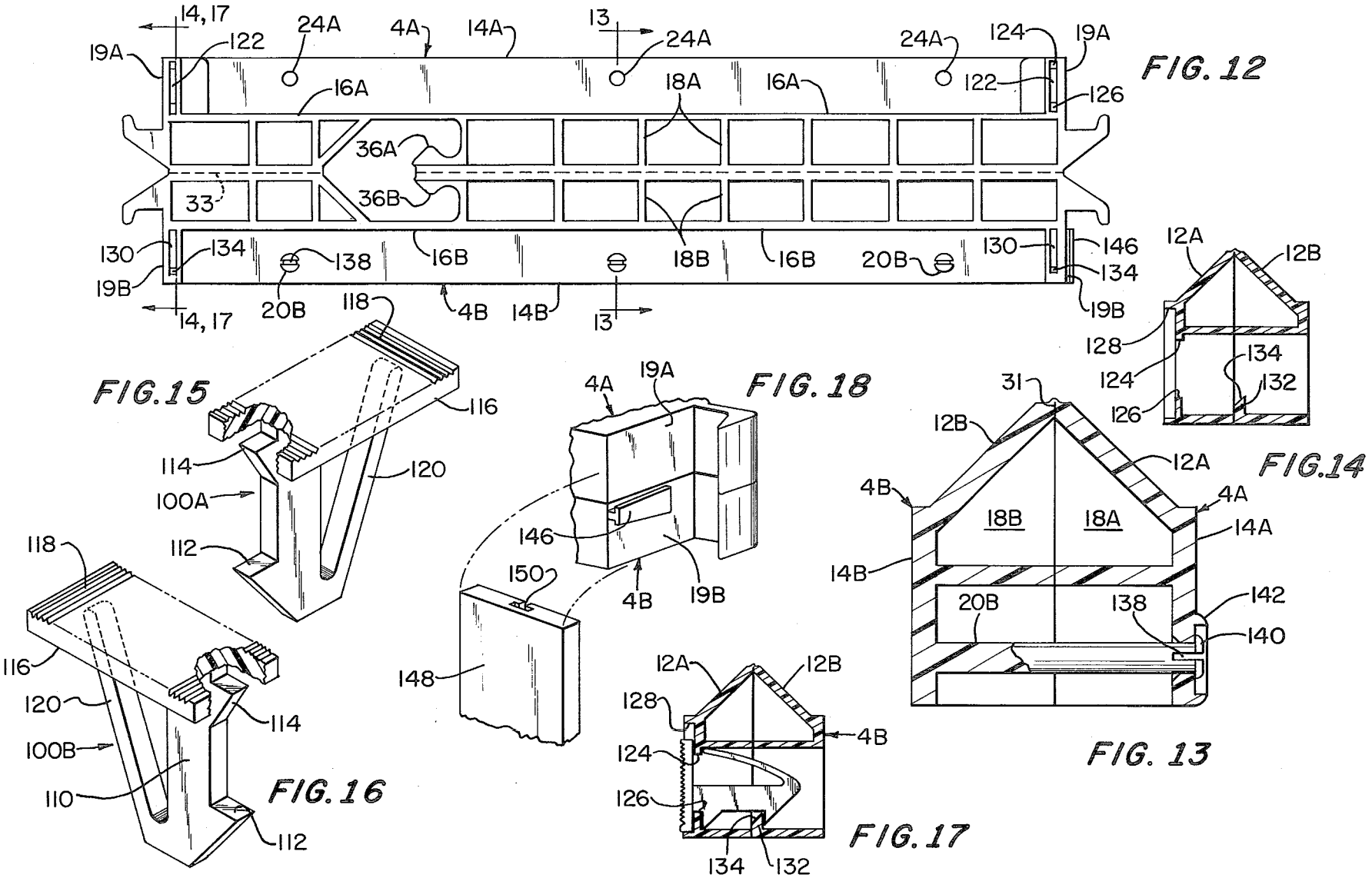
FIG. 12 is a bottom view of the holder of FIG. 11 in open condition.
FIG. 13 is an enlarged cross-sectional view of the same holder in closed condition, with the section being taken along a line corresponding substantially to line 13—13 of FIG. 12.
FIG. 14 is another cross-sectional view taken along a line corresponding substantially to line 14—14 of FIG. 12.
FIGS. 15 and 16 are fragmentary perspective views of the two locking elements of the holder of FIGS. 11-14.
FIG. 17 is a cross-sectional view like FIG. 14 but including a locking element.
FIG. 18 is a fragmentary exploded view in perspective of one end of the document holder of FIG. 11 and the removable label holder.

The embodiment shown in FIGS. 11–18 is generally the same as the embodiment described above but differs primarily in its locking means. In this second embodiment the locking is achieved by two latch elements 100A and 100B which are mounted in opposite ends of limb 14A. Latch elements 100A and 100B are made of a resilient plastic and are molded as mirror images of one another. Each comprises a body section 110 which has a first wedge-shaped hook 112 on one edge at one end and a second wedge-shaped hook 114 on the same edge but closer to its other end. The latter end is formed integral with a flat button 116 having a knurled outer surface 118. Also formed integral with body section 110 is a finger 120 which functions as a leaf spring. The latch elements are mounted in the two end walls 19A of side section 4A. For this purpose end walls 19A are made thicker than in the embodiment of FIGS. 1–16 and additionally they are formed with like openings 122 that are elongated in a plane extending at a right angle to partition 16A. Openings 122 extend through the limb 14A but are reduced in size at that end so as to form two opposed overhangs or lips 124 and 126 (FIGS. 12 and 17). Additionally, at each end of the holder the outer surface limb 14A is formed with a shallow rectangular depression 128 which intersects the opening 122 at that end. Latch elements 100A and 100B are inserted into openings 122 from the outer side of limb 14A, with the spring fingers 120 yielding toward the body sections 110 enough to permit the hooks 114 to pass by the lips 126. As soon as spring fingers 120 have passed by lips 124, they spring away from body section 110 against partition 116 and thereby cause the hooks 114 to interlock with lips 126 in the manner shown in FIG. 17. Buttons 116 prevent the catches from moving completely through openings 122.

In order for latch elements 100A and 100B to interlock with side section 4B, an opening 130 is formed in each of the end walls 19B which are made thicker than those of the embodiment of FIGS. 1–10. Openings 130 are elongate transversely to the partition 16B and may but need not extend through the outer surface of limb 14B. At the inner side of each opening 130 a lip 132 is formed which preferably but not necessarily is bevelled as shown at 134. Lips 132 function as catches and interact with hooks 112 of the latch elements to lock the holder closed. The bevels 134 act as cams to force the latch elements to move toward partition 16B so that hooks 112 can pass around and interlock with catches 132 when the side sections 4A and 4B are swung into closed positions. The holder is opened by manually shifting the buttons in the depressions 128 in a direction to compress springs 120 and hooks 112 to clear catches 132. Springs 120 automatically return the latches to the position shown in FIGS. 1 and 17 when the buttons are released.

FIGS. 12 and 13 illustrate a further optional feature of the invention. In this case the holder is formed with document mounting posts 20B whose free ends are slotted to form two sections 138 and also have a peripheral flange 140. The post-receiving holes 24A are sized so that the split ends of the posts must contract radially by deflection of sections 138 in order for the peripheral flange 140 to be able to pass through. The sections 138 spring apart again as soon as the flange 140 has cleared holes 24 and thereupon the flanges interlock with the outer surface of limb 14A to help keep the holder closed. To avoid possible injury to persons handling the holder, the limb 14A may be molded with a circular rib 142 on its outer surface concentric with each hole 24A. Each rib is formed so that it projects beyond the end of the post 20B that is received by the associated hole 24, as shown in FIG. 13.

FIG. 18 illustrates a further option of having the label-supporting tab formed as a separate and detachable member. In this case one of the end walls 19B of side section 4B is formed with a dovetail 146 and a label holder 148 is formed with a mating dovetail groove 150. Dovetail 146 and groove 150 are sized to make a tight sliding fit so that a suitable force is required to detach the label holder.

The holders herein described may be suspended by means of its end hooks 44 from a pair of parallel side rails, so that it and its contents may be stored in a file drawer in the manner of a hanging folder. It also may be suspended by means of its hook section 32 form a suitable hanger.

We claim:

1. A document holder comprising a one-piece body molded of plastic and having first and second side sections, a single integral hinge section connecting said side sections, and a pair of holes in said first side section, said one-piece unit being molded with said hinge section unfolded and said side sections being separated from one another and said hinge section being foldable so as to bring said side sections into confronting relation with one another, a pair of document mounting posts attached to the second side section, said posts being located so that the free end of each is received by one of said holes when said side sections are in confronting relation with one another, said side sections being formed so that when they confront one another they form a channel for receiving margin portions of documents to be mounted on said posts, and lock means separate from said posts for locking said side sections together in mutually confronting relation, said lock means comprising at least one movable latch attached to one of said side sections and a catch disposed on the other of said side sections in position to engage and positively hold said at least one latch when said side sections are removed into said mutually confronting relation.

2. A document holder according to claim 1 wherein said side sections are provided with shaped means that cooperate to form a hook intermediate the ends of said body when said side sections are locked together.

3. A document holder according to claim 1 wherein said side sections are formed with integral end means that cooperate to form a fixed hook at each end of said holder body when said side sections are locked together, said hook extending the full width of said holder body.

4. A document holder according to claim 1 wherein said hinge section is characterized by a groove extending longitudinally of said holder body.

5. A document holder according to claim 4 wherein said side sections and said hinge section each have an inner surface and an outer surface, the inner surfaces of said side sections confront one another when said side sections are locked together, and said groove is on the outer surface of said hinge section.

6. A document holder according to claim 1 wherein said lock means further comprises means for resiliently urging said at least one latch to a locking position, said catch being formed integral with the other side section.

7. A document holder according to claim 6 wherein said lock means comprises at least one catch and a cooperating latch adjacent each end of said holder body.

8. A document holder according to claim 7 wherein all of the latches are connected to move as a unit.

9. A document holder according to claim 8 wherein said latches are formed and disposed so as to extend at a right angle to said side sections.

10. A document holder according to claim 8 wherein said latches are flat elements and are substantially coplanar with one another.

11. A document holder according to claim 10 wherein said lock means includes a bar connecting all of said latches.

12. A document holder according to claim 7 wherein said latches are movable independently of one another.

13. A document holder according to claim 12 wherein said latches are formed and disposed so as to extend at a right angle to said side sections.

14. A document holder according to claim 12 wherein said latches are flat elements and extend substantially parallel to one another.

15. A document holder according to claim 7 wherein each latch is attached to and movable with an actuating button resiliently urged to one extreme of its travel and further wherein each of said buttons is movably disposed on the outer surface of said one side section when said side sections are locked together.

16. A document holder according to claim 15 wherein each of said buttons is disposed in a recess in said first side section.

17. A document holder according to claim 1 wherein said posts are formed as an integral part of said second side section.

18. A filing device for binding stationery materials comprising an elongate plastic holder defining an open channel and at least two posts carried by said holder for releasably securing one or more sheets of stationery materials disposed in said channel, said holder comprising opposed side sections and a single hinge connecting said side sections whereby said side sections may be moved between a closed position wherein they form said channel and an open position wherein said channel is eliminated, said side sections and said hinge being made of the same material and formed integral with one another, and means separate from said posts for releasably locking said side sections positively to each other in said closed position.

19. A device according to claim 18 wherein each of said posts is affixed to one of said side sections and is disposed in aligned holes formed in the other of said side sections.

20. A device according to claim 19 wherein said locking means comprises latch means carried by one side section and catch means carried by the other side section in position to be engaged by and positively locked to said latch means.

21. A device according to claim 18 and further including a label holder removably attached to an end wall of one of said side sections.

22. A document holder according to claim 1 wherein said side sections when locked together further form a substantially enclosed garret space separate from said channel, said garret space extending substantially the length of said holder and widening in cross-section between said hinge and said channel.

23. A device according to claim 18 wherein a substantially enclosed garret space is formed in said closed position separate from said channel and disposed between the latter and said hinge, said garret space extending substantially the length of said holder and having a cross-section of increasing width between said hinge and said channel.

24. An elongated holder for documents comprising:

a unitary body of molded plastic including first and second side sections coupled by a single, foldable hinge section integral with said side sections;

each of said side section including a side wall adjacent said hinge section and extending outwardly therefrom;

a side limb integrally continuing from said side wall; and a partition integral with said side limb and extending inwardly therefrom;

said hinge section permitting relative motion of said side sections to position said side limbs parallel to each other when said holder is closed;

said partitions confronting one another in the closed position of said holder, said confronting partitions and said side walls jointly defining a garret space extending substantially the length of said holder and widening in cross-section between said hinge and said confronting partitions;

a plurality of holes disposed in the side limb of said first side section;

a corresponding plurality of posts extending inwardly from the side limb of said second side section, said posts being positioned such that the free end of each is received by one of said holes in the closed position of said holder;

said side limbs and said confronting partitions defining a channel separate from said garret space and extending the length of said holder, said channel being adapted to receive margin portions of said documents perforated for mounting on said posts, and means for positively locking said side sections together in said closed position.

25. The apparatus of claim 24 and further including a plurality of reinforcing struts integral with each side section and extending inwardly normal to said partition and to said side limb, corresponding reinforcing struts of respective ones of said side sections confronting one another in said closed position to segment said garret space lengthwise of said holder.

26. A document holder according to claim 25 wherein said lock means comprises at least one latch movably attached to said first side section, means for resiliently urging said latch to a latching position, and a catch corresponding to said latch positioned on said second side section, said catch being adapted to hold said latch so as to maintain said closed position of said holder.

27. A document holder according to claim 26 wherein a plurality of said latches and corresponding catches are spaced along the long dimension of said holder.

28. A document holder according to claim 27 wherein each of said catches is integral with said second side section.

29. A document holder according to claim 27 wherein said latches are interconnected to move as a unit.

30. A document holder according to claim 27 wherein said latches are independently movable.

31. A document holder according to claim 26 wherein said latch includes an actuating button movably disposed on the outer surface of said first side section, said button being urged to one extreme of its travel by said resilient means.

32. A document holder according to claim 29 wherein said posts are formed as an integral part of said second side section.

* * * * *

UNITED STATES PATENT AND TRADEMARK OFFICE

CERTIFICATE OF CORRECTION

PATENT NO. : 4,056,296

DATED : November 1, 1977

INVENTOR(S) : Norman Hedstrom et al

It is certified that error appears in the above-identified patent and that said Letters Patent are hereby corrected as shown below:

| | |
|---|---|
| Column 5, line 19: | Change number following the word "unit" to "68". |
| Column 5, line 26: | Substitute the word "all" for the word "will". |
| Column 7, line 35: | Insert the word "to" before the word "form". |
| Column 7, line 60: | Delete the word "removed" and substitute therefor the word "moved". |

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*